US006192937B1

(12) United States Patent
Fagerlie et al.

(10) Patent No.: US 6,192,937 B1
(45) Date of Patent: Feb. 27, 2001

(54) PILOT OPERATED PNEUMATIC VALVE

(75) Inventors: Richard A. Fagerlie, New Smyrna Beach, FL (US); James A. Neff, Bloomfield, MI (US)

(73) Assignee: MAC Valves, Inc., Wixom, MI (US)

( * ) Notice: Subject to any disclaimer, the term of this patent is extended or adjusted under 35 U.S.C. 154(b) by 0 days.

(21) Appl. No.: 09/299,703

(22) Filed: Apr. 26, 1999

(51) Int. Cl.[7] ..... F15B 13/043
(52) U.S. Cl. ..... 137/625.63; 137/625.64
(58) Field of Search ..... 137/625.63, 625.64

(56) References Cited

U.S. PATENT DOCUMENTS

| | | | | |
|---|---|---|---|---|
| 2,655,939 | * | 10/1953 | Tauscher et al. | 137/625.63 |
| 2,709,421 | * | 5/1955 | Avery | 137/625.63 |
| 2,953,123 | * | 9/1960 | Reen et al. | 137/625.63 |
| 2,970,575 | * | 2/1961 | Stern | 137/625.64 X |
| 3,126,031 | * | 3/1964 | Hayner | 137/625.63 X |
| 4,215,723 | * | 8/1980 | Ichiryu et al. | 137/625.64 X |
| 4,267,862 | * | 5/1981 | Neff et al. | 137/625.64 |
| 4,453,565 | * | 6/1984 | Neff | 137/625.64 X |
| 4,462,427 | * | 7/1984 | Neff | 137/625.64 |
| 4,465,100 | * | 8/1984 | Neff | 137/625.64 |
| 4,485,846 | * | 12/1984 | Neff | 137/625.64 |
| 4,574,844 | | 3/1986 | Neff et al. | 137/625.65 |
| 5,092,365 | | 3/1992 | Neff | 137/625.65 |
| 5,136,774 | | 8/1992 | Neff | 29/602.1 |
| 5,192,936 | | 3/1993 | Neff et al. | 335/281 |
| 5,666,994 | * | 9/1997 | Stoll et al. | 137/625.64 |

FOREIGN PATENT DOCUMENTS

| | | | | |
|---|---|---|---|---|
| 5-231558 | * | 9/1993 | (JP) | 137/625.64 |

* cited by examiner

*Primary Examiner*—Gerald A. Michalsky
(74) *Attorney, Agent, or Firm*—Bliss McGlynn, P.C.

(57) ABSTRACT

A pilot operated valve assembly including a valve body having a pressurized air supply inlet port in communication with a source of pressurized air and at least one cylinder passage. A main valve bore extends axially within the valve body and a main valve member is movable between predetermined positions within the main valve bore to selectively direct pressurized air from the inlet port through at least one cylinder passage. A pilot valve bore is formed integrally within the valve body and extends parallel to, and spaced a short distance from, the main valve bore. A pair of short pilot cylinder ports spaced apart from one another extend between the main valve bore and the pilot valve bore. A pilot valve member is movable between predetermined positions within the pilot valve bore to selectively direct air from the pilot valve bore through alternating ones of the pilot cylinder ports to act upon the main valve member thereby moving the main valve member between predetermined positions.

9 Claims, 3 Drawing Sheets

PILOT OPERATED PNEUMATIC VALVE

BACKGROUND OF THE INVENTION

1. Field of the Invention

The invention relates, generally, to pneumatic valve assemblies and, more specifically, to a pneumatic valve having a pilot valve integrated into a single valve body.

2. Description of the Related Art

Pilot operated pneumatic valves are well known in the art for controlling the flow of pressurized air to and from various pneumatically actuated devices such as press clutches, air brakes, air cylinders or any other pneumatic device or application requiring precise control of operating air. More specifically, two-way, three-way and four-way pilot operated valve assemblies are commonly employed in these environments. Such valves typically include a main valve body with a valve member movably supported within a valve bore in response to air pressure which is directed by a separate pilot valve to one or alternating ends of the valve member. A solenoid actuates the pilot valve to one predetermined position. A return spring or another pilot valve is employed to bias the valve member back to a known position.

Valve assemblies of this type known in the related art typically include a main valve body to which is separately mounted a pilot valve body using fasteners. Valves of this type are employed in a wide variety of manufacturing environments where a high flow rate and very fast response time are desired. As the technology for these valves has advanced, there has been an increase in the demand for smaller valves which are used in tight spaces. Over the years, there have been a number of improvements in this general field which have facilitated high flow rates and fast response times in relatively small valves. Still, there remains a need in the art for even faster and smaller valves. However, the common arrangement wherein a pilot valve is mounted to a main valve has become a design barrier which has affected the size and speed of such valves.

SUMMARY OF THE INVENTION

The present invention overcomes these design barriers and other disadvantages of the related art in a pilot operated valve assembly. More specifically, the present invention is directed toward an improved pilot operated valve assembly including a valve body having a pressurized air supply inlet port in communication with a source of pressurized air and at least one cylinder passage. A main valve bore extends axially within the valve body and a valve member is movable between predetermined positions within the main valve bore to selectively direct pressurized air from the inlet port through at least one cylinder passage. A pilot valve bore is also integrally formed within the valve body and extends parallel to, and spaced a short distance from, the main valve bore. A pair of short pilot cylinder ports are spaced apart from one another and extend between the main valve bore and the pilot valve bore. A pilot valve member is movably supported between predetermined positions within the pilot valve bore to selectively direct pressurized air from the pilot valve bore through alternating ones of the pilot cylinder ports to act upon the main valve member thereby moving the main valve member between its predetermined positions.

The pilot operated valve assembly of the present invention has distinct advantages over the valves known in the related art. More specifically, it is small and very thin—in one embodiment only 10 mm wide. Thus, it is easily employed in environments where space is at a premium. The small size of the pneumatic valve of the present invention is facilitated by the pilot valve being integrated into the main valve body. In turn, this feature is made possible by the position of the pilot valve bore being disposed parallel to and immediately adjacent the main valve bore. These bores are connected by very short pilot cylinder ports which direct fluid flow to and from the main valve bore and immediately adjacent to either side of the main valve member to cycle the valve member between predetermined positions. These short pilot cylinder ports minimize the volume of air required to be filled and dumped from the ends of the main valve member every time the valve is actuated. This structure results in extremely fast and consistent response times.

Further, because the pilot valve is integrated into the main valve body, various parts including fasteners, gaskets and machining and assembly operations are eliminated. The integrated pilot operated valve assembly facilitates the thinness of the valve because, heretofore, it was difficult to mount a pilot valve to a main valve body having only, for example, a 10 mm thickness. The pilot operated valve assembly also has impressive flow efficiency and a short stroke. In addition, the valve assembly of the present invention provides a large flow of fluid therethrough when the main valve member is in either one of its two operating positions. The short stroke feature and compactness of the valve provides an efficiently operating valve which can be actuated by a small size general purpose solenoid with low wattage or high wattage power consumption.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
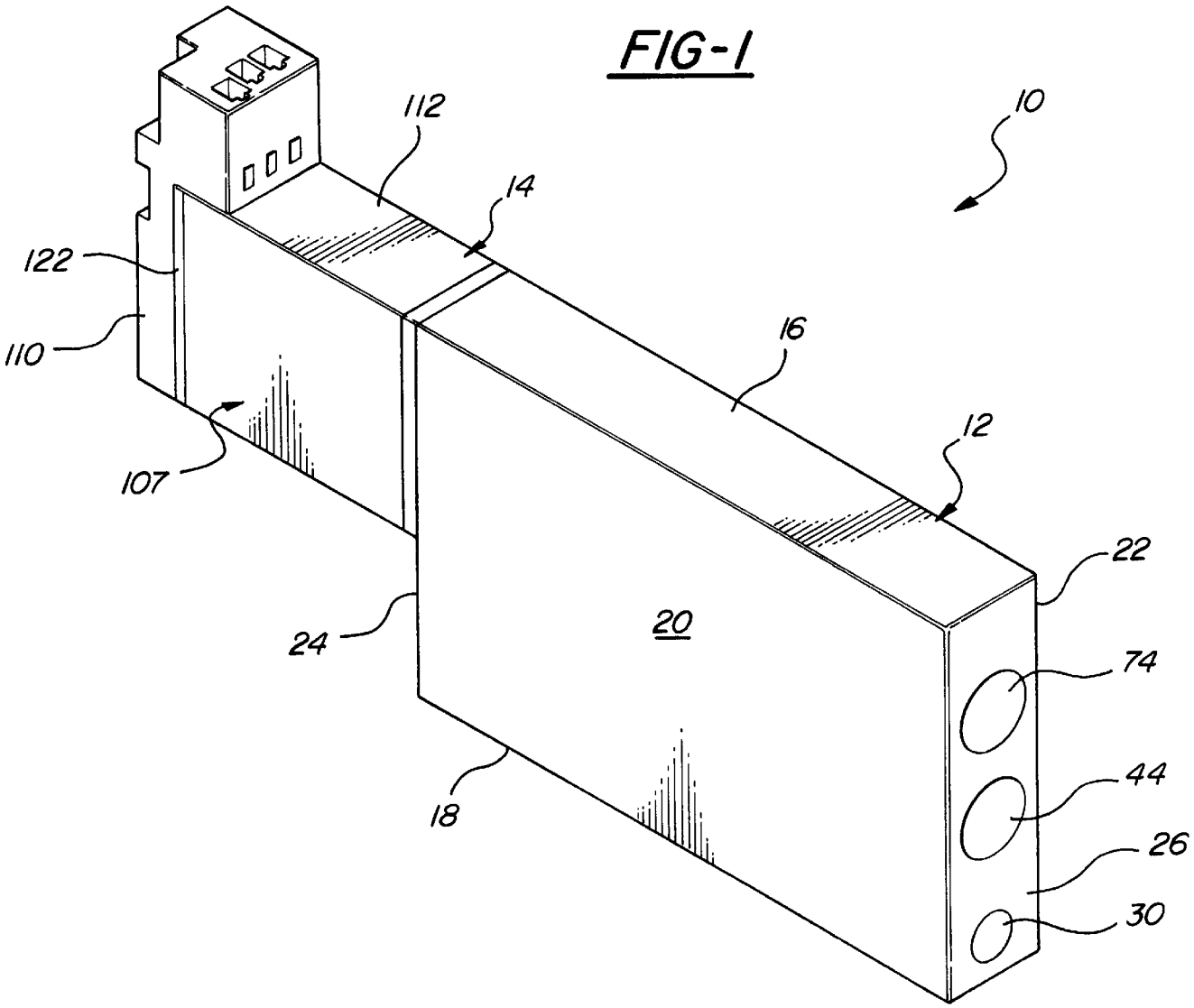
FIG. 1 is a perspective view of the valve assembly of the present invention.

Referring now to the figures where like numerals are used to designate like structure throughout the drawings, a pilot operated valve assembly of the present invention is generally indicated at 10. As shown in FIG. 1, the valve assembly 10 includes a valve body 12 and an electromagnetic actuator, such as a solenoid assembly, generally indicated at 14 and mounted to the valve body 12. The valve body 12 has a thin rectangular shape defining top and bottom surfaces 16, 18, respectively, a pair of opposed side surfaces 20, 22 extending between the top and bottom surfaces 16 and 18 and end surfaces 24, 26. The solenoid assembly 14 is mounted to the end surface 24 of the valve body 12. The valve body 12 is adapted to be mounted to a manifold, sub-base, or any of a number of various pneumatically actuated devices (not shown). To this end, the valve body 12 may include apertures, such as the one illustrated at 28 and 30 in the end surfaces 24, 26, respectively in FIGS. 2 and 3, for receiving a fastener (not shown).

Figure 2:
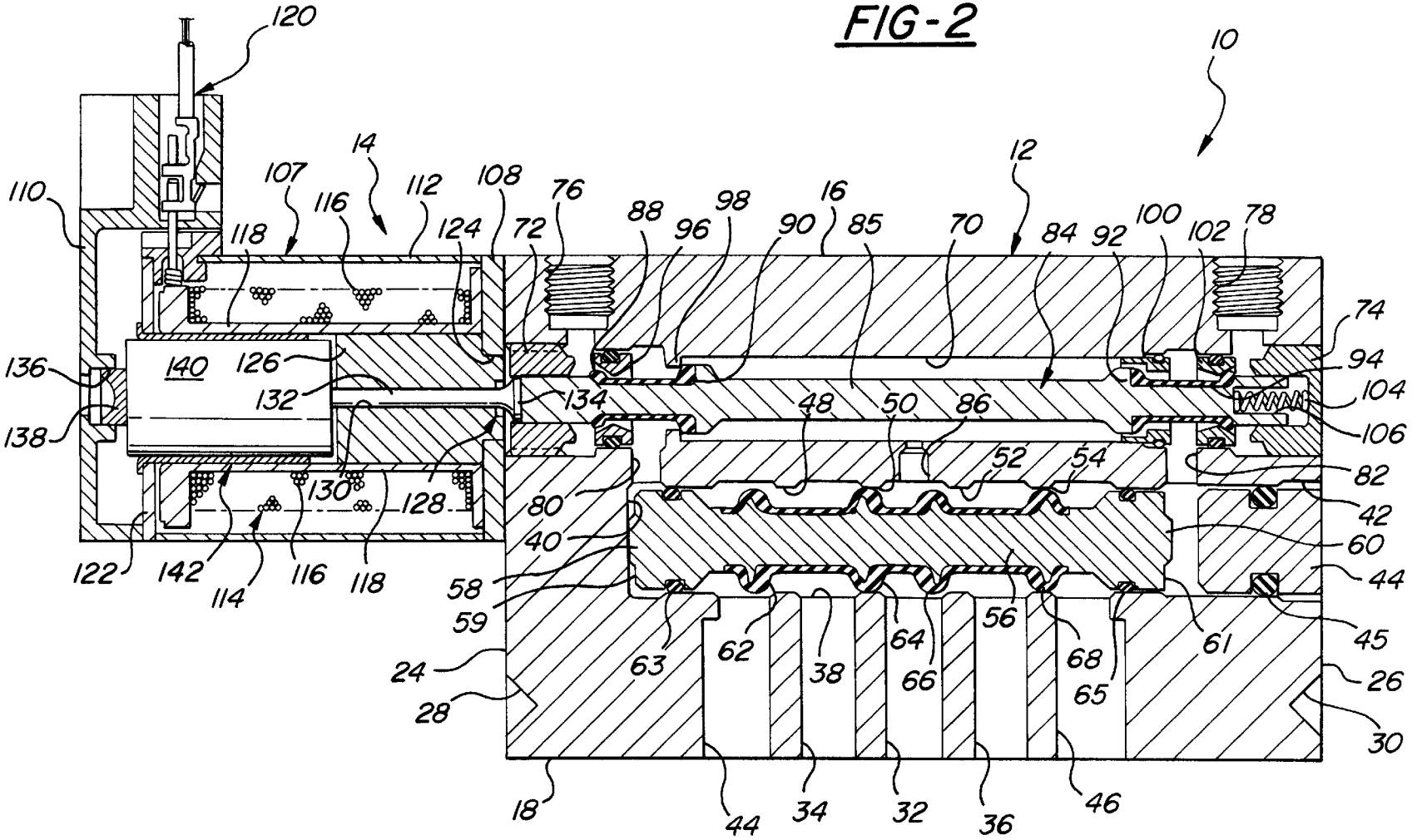
FIG. 2 is a cross-sectional side view of the valve assembly of the present invention illustrating the position of both the pilot and main valve members when the solenoid is de-energized.
Figure 3:
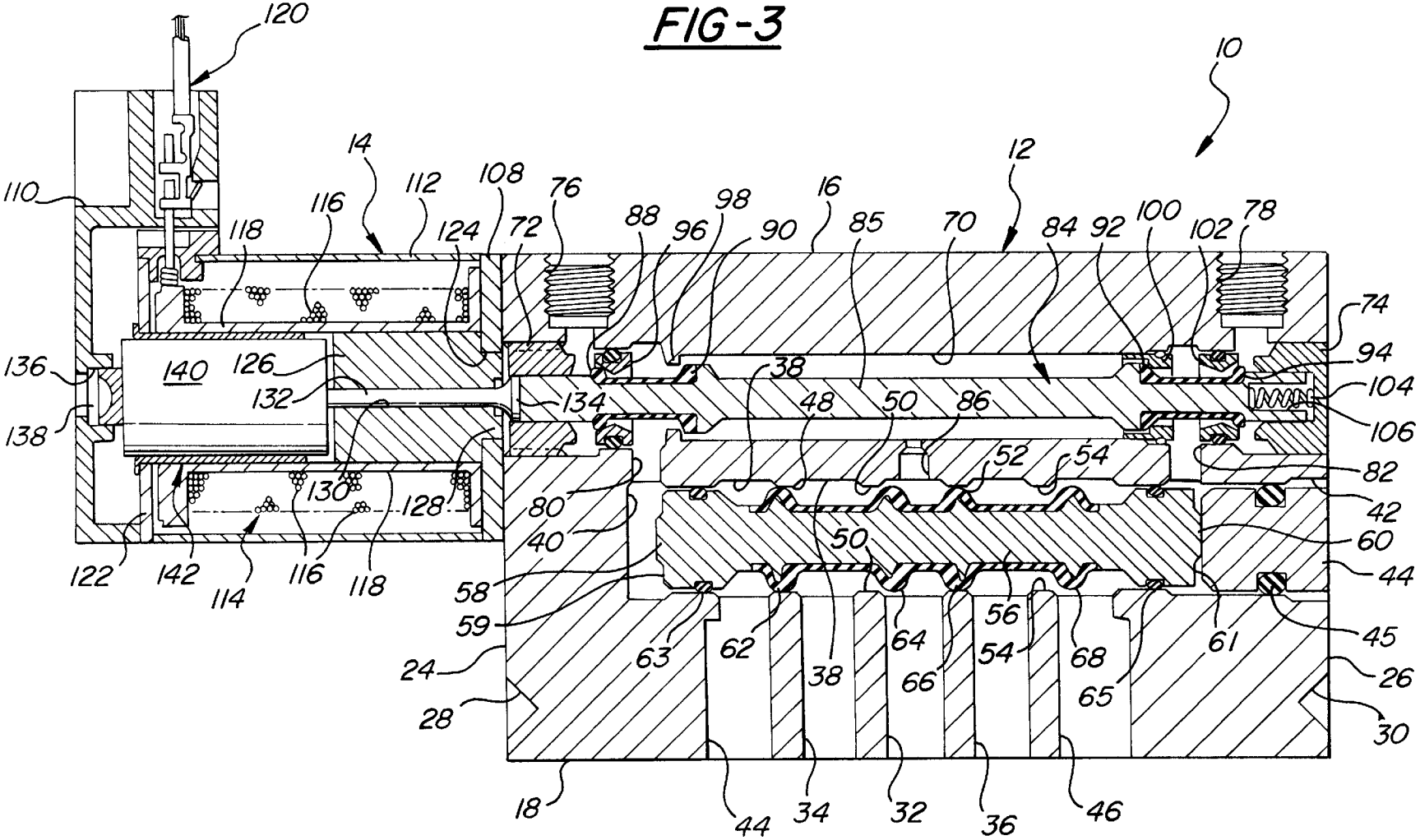
FIG. 3 is a cross-sectional side view of the valve assembly of the present invention illustrating the position of both the pilot and main valve members when the solenoid is energized.

The pilot operated valve assembly 10 illustrated here may be a two-way valve, a three-way valve, a four-way valve or the like. Referring now to FIGS. 2 and 3, the valve body 12 includes a pressurized fluid inlet port 32 for communicating with a source of pressurized fluid, such as air. Furthermore, the valve body 12 includes at least one cylinder passage 34, 36. A main valve bore 3 8 extends axially within the valve body 12. The main valve bore 38 has a blind end 40 and an open end 42 which is closed by a threadable end stop 44 mounted in the open end 42 of the main valve bore 38. The end stop includes an annular seal 45 to ensure that the end 42 is air tight. Here, the pilot operated valve assembly 10 is a four-way valve and includes a pair of cylinder passages 34, 36 and a pair of exhaust passages 44, 46 each in fluid communication with the main valve bore 38. The main valve bore 38 further includes a plurality of lands 48, 50, 52, 54 forming areas of reduced diameter within the main valve bore 38. A main valve member 56 is movable between predetermined positions within the main valve bore 38 to selectively direct pressurized air from the inlet port 32 through at least one of the cylinder passages 34, 36 and at least one of the exhaust passages 44, 46.

In one preferred embodiment, the main valve member 56 includes a spool valve comprised of an aluminum insert having a pair of opposed valve heads 58, 60 disposed at either end of the spool valve 56. Each valve head 58, 60 presents a piston surface 59, 61, respectively, extending transversely relative to the main valve bore 38. Each valve head 58, 60 also includes an end seal 63, 65, respectively, annularly disposed thereabout. The aluminum insert spool valve 56 is over molded and bonded with rubber to form a plurality of valve elements 62, 64, 66, 68 defined between the opposed valve heads 58, 60. The valve elements 62, 64, 66, 68 form areas of greater diameter on the spool valve and cooperate with the lands 48, 50, 52, 54 on the main valve bore 38 to direct fluid from the main valve bore 38 through various ones of the pair of cylinder passages 34, 36 and pair of exhaust passages 44, 46.

The pilot operated valve assembly 10 of the present invention further includes a pilot valve bore 70 formed integrally within the valve body 12 and extending parallel to, and spaced a short distance from, the main valve bore 38. More specifically, the main valve bore 38 and the pilot valve bore 70 are positioned relative to one another such that the centerline of each of these bores is contained in a single plane which is parallel to the longitudinal axis of the valve body 12. A pilot valve inlet passage 86 extends between the pilot and main valve bores and supplies the pilot valve bore 70 with pressurized air. In the embodiment shown here, the pilot valve bore 70 extends longitudinally through the entire valve body 12. A pair of retainers 72, 74 are threadably mounted in each end of the pilot valve bore 70. Furthermore, the valve body 12 includes at least one, but preferably two, pilot exhaust ports 76, 78 spaced relative to one another and each located near a respective retainer 72, 74.

A pair of short pilot cylinder ports 80, 82 are spaced apart from one another and extend between the main valve bore 38 and the pilot valve bore 70. A pilot valve member 84 is movable between predetermined positions within the pilot valve bore 70 to selectively direct air from the pilot valve bore 38 through alternating ones of the pilot cylinder ports 80, 82 to act upon the main valve member 56 thereby moving the main valve member 56 between its predetermined positions. The pilot valve member 84 is further operable to direct pressurized air from the main valve bore 38 though alternating ones of the pilot cylinder ports 80, 82 and out at least one pilot exhaust port 76, 78. Importantly, the pilot cylinder ports 80, 82 communicate with the main valve bore 38 immediately adjacent the opposed spool valve head 58, 60 to alternatingly direct fluid pressure against the valve heads 58, 60 and exhaust fluid pressure away from the valve heads 58, 60 thereby moving the spool valve 56 between its predetermined positions. Each piston surface 59, 61 is aligned flush with one side of the corresponding pilot cylinder port 80, 82, as viewed in cross-section, when fluid has been directed against an associated valve head 58, 60.

In one preferred embodiment, the pilot valve member 84 includes a poppet valve made of an aluminum insert having an elongated, reduced diameter portion 85 disposed between a pair of valve elements 88, 90 and 92, 94. The valve elements 88, 90 and 92, 94 are over molded and bonded with rubber and located distal to either end of the poppet valve member 84. Each of the pair of valve elements includes a medial valve 90, 92 and a lateral valve 88, 94. Each of the medial valves 90, 92 control the flow of fluid between the pilot valve bore 70 and the main valve bore 38 through one of the pair of pilot cylinder ports 80, 82. In addition, each of the lateral valves 88, 94 control the flow of fluid between the main valve bore 38 and the pilot exhaust ports 76, 78 through one of the pair of pilot cylinder ports 80, 82. The pilot valve bore 70 presents a plurality of valve seats 96, 98, 100, 102 which are formed in the pilot valve bore 70 or which are presented by the threadably adjustable retainers 72, 74 located at either end of the pilot valve bore 70. The valve seats 96, 98, 100, 102 cooperate with the valve elements 88, 90, 92, 94, respectively, to seal various passages in the valve as will be discussed in greater detail below. The elongated reduced diameter portion 85 of the pilot valve member 84 between the pair of valve elements 88, 90 and 92, 94 creates a pressure accumulator in the pilot valve bore 70 of sufficient volume such that it reduces the pressure drop therein when the pilot valve and main valve shifts.

To this end, the pilot operated valve assembly 10 includes a biasing member 104 which moves the pilot valve member 84 in one direction and an electromagnetic actuator 14 for moving the pilot valve member 84 in an opposite direction. Here, the biasing member includes a coiled spring 104 disposed between the retainer 74 and a recess 106 in one end of the pilot valve member 84 to bias the pilot valve member 84 to the left as shown in FIG. 2.

On the other hand, and as alluded to above, the electromagnetic actuator is a solenoid assembly 14 mounted to the valve body 12 so as to actuate the pilot valve member 84 within the pilot valve bore 70 in a direction opposite to the biasing force of the coiled spring 104 as shown in FIG. 3.

The solenoid assembly 14 includes a thin, rectangular shaped housing, generally indicated at 107. The housing 107 includes a pole plate 108 abutting the valve body 12, a cap 110 disposed opposite the pole plate 108 and a solenoid can or frame 112 extending therebetween. The frame 112 supports a coil 114 including a conductive wire 116 conventionally wrapped around a bobbin 118. The conductive wire 116 is connected to a source of electrical current through leads, generally indicated at 120. The direction of the current through the coil 114 and thus the direction of the electromagnetic force generated thereby is controlled by a control circuit (not shown). A top plate 122 is mounted adjacent the bobbin 118 and between the frame 112 and the cap 110.

The pole plate 108 includes an opening 124 extending therethrough. The solenoid assembly 14 further includes a ferromagnetic pole piece 126 having a stepped portion 128 with a smaller cross-sectional area than the rest of the pole piece 126. The stepped portion 128 is received in the opening 124 in the pole plate 108 for mechanically fixing the pole piece 126 to the pole plate 108. A centrally located passage 130 extends through the pole piece 126. A pushpin 132 having an enlarged head 134 at one end thereof is movably supported in the passage 130 and acts on the pilot valve member 84 to move it against the biasing force of the coiled spring 104.

An armature 140 is disposed between the cap 110 and the pole piece 126. A bushing 142 isolates the armature 140 from the bobbin 118. The armature 140 is movable toward the pole piece 126 under the influence of an electromagnetic flux generated by a pulse of current flowing through the coil 114. The armature 140 drives the pushpin 132 to move the pilot valve member 84 to one predetermined position and against the biasing force of the coiled spring 104. Furthermore, the armature 140 is movable away from the pole piece 126 and toward the cap 110 under the biasing influence of the coil spring 104 acting on the pilot valve member 84 through the pushpin 132 when the current through the coil 114 is interrupted. In this way, the pilot valve member 84 is cycled between its positions to control the flow of pressurized air through the valve body 12 as will be described in greater detail below. The cap 110 of the solenoid housing 107 includes an aperture 136. A manual operator 138 is movably mounted in the aperture 136. The manual operator 138 is, in essence, a plastic button which may be employed to activate the armature and therefore the pilot valve member 84 in the absence of electrical power.

Operation

In operation, fluid, such as air, enters the valve body 12 via the main valve inlet port 32, flows into the main valve bore 38, past the main spool valve member 56, through the pilot inlet port 86 and into the pilot valve bore 70. The flow of air through the pilot valve is controlled by the movement of the solenoid actuated pilot valve member 84. When the solenoid member 14 is actuated, the pilot valve member 84 is moved to the right as viewed in FIG. 3. The medial valve element 90 is spaced from the valve seat 98 and therefore now open. Air from the pilot valve bore 70 flows directly into the short cylinder port 80 and acts on the piston surface 59 of the left valve head 58 to move the main valve member 56 to the right as viewed in FIG. 3. Pilot exhaust port 76 is sealed by lateral valve element 88 cooperating with valve seat 96. At the same time, air from the main valve bore 38 adjacent the right valve head 60 is immediately exhausted through the pilot cylinder port 82 past the open lateral valve element 94 which is now spaced from valve seat 102 and out pilot exhaust port 78.

When the main valve member 56 is moved to the right as dictated by the position of the pilot valve member 84 as viewed in FIG. 3, air from the main valve inlet 32 is directed from the main valve bore 38 past valve element 64 and land 50 and into main cylinder passage 34. At the same time, valve element 66 cooperates with land 52 to seal the main valve bore 38 left of the land 52 as viewed in FIG. 3 and air from the cylinder passage 36 is exhausted past valve element 68 and land 54 through exhaust passage 46.

When the solenoid assembly 14 is de-energized, the return spring 104 moves the pilot valve member 84 back to the left, as viewed in FIG. 2. Air entering the pilot valve is then directed past medial valve element 92 which is spaced from valve seat 100 into the short pilot cylinder port 82 and is directed against the piston surface 61 of the right main valve head 60 to move the main spool valve member 56 to the left as viewed in FIG. 2. The pilot exhaust port 78 is sealed by the lateral valve element 94 cooperating with the valve seat 102. At the same time, pilot exhaust port 76 is opened to exhaust air from the main valve bore 38 adjacent to the left valve head 58 through the short pilot cylinder port 80 past the lateral valve element 88 and the valve seat 96 and out pilot exhaust port 76.

When the main spool valve member 56 moves to the left, the exhaust passage 46 is sealed as the valve element 68 cooperates with the land 54. Air from the main valve inlet 32 flows from the main valve bore 38, past valve element 66 and land 52 into the main cylinder passage 36. At the same time, air from the main cylinder passage 34 flows into the main valve bore 38 past valve element 62 and land 48 and is exhausted via the exhaust passage 44.

The structure of the pilot operated valve assembly 10 of the present invention as described above has distinct advantages over the valves known in the related art. More specifically, the pilot operated valve assembly 10 of the present invention is very small and thin—in one embodiment only 10 mm wide. Thus, it is easily employed in environments where space is at a premium. The small size of the pneumatic valve of the present invention is facilitated by the pilot valve being integrated into the main valve body 12. In turn, this feature is made possible by the position of the pilot valve bore 70 being disposed parallel to and immediately adjacent to the main valve bore 38. These bores are connected by very short pilot cylinder ports 80, 82 to direct fluid flow to and from the main valve bore 38 and immediately adjacent to the opposed valve heads 58, 60 on the main valve member 56 to cycle the main valve member 56 between predetermined positions. The structure results in extremely fast response time and high flow rates through the valve 10.

Further, because the pilot valve is integrated into the main valve body 12, various parts including fasteners, gaskets and machining and assembly operations are eliminated. The integrated pilot operated valve assembly 10 further facilitates the thinness of the valve because, heretofore, it was difficult to mount a pilot valve to a main valve body having only, for example, a 10 mm thickness. The pilot operated valve assembly 10 of the present invention also has impressive flow efficiency and a short stroke. In addition, the valve assembly 10 of the present invention provides a large flow of fluid therethrough when the main valve member is in either one of its two operating positions. The short stroke feature and compactness of the valve provides an efficiently operating valve which can be actuated by small size, general purpose solenoid assembly 14 with low wattage or high wattage power consumption.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

We claim:

1. A pilot operated valve assembly comprising:

a valve body having a pressurized air supply inlet port in communication with a source of pressurized air, and at least one cylinder passage;

a main valve bore extending axially within said valve body and a main valve member including a spool valve having a pair of opposed valve heads disposed at either end of said spool valve, said opposed valve heads presenting a piston surface extending transversely relative to said main valve bore, said main valve member being movable between predetermined positions within said main valve bore to selectively direct pressurized air from said inlet port through said at least one cylinder passage;

a pilot valve bore formed integrally within said valve body and extending parallel to and spaced a short distance from said main valve bore;

a pair of short pilot cylinder ports spaced apart from one another and extending between said main valve bore and said pilot valve bore, said pilot cylinder ports communicating with said main valve bore immediately adjacent said opposed spool valve heads with each piston surface being aligned flush with a corresponding one of said pilot cylinder ports as viewed in cross-section to alternatingly direct fluid pressure against said valve heads thereby moving said spool valve between said predetermined positions; and a pilot valve member movable between predetermined positions within said pilot valve bore to selectively direct air from said pilot valve bore through alternating ones of said pilot cylinder ports to act upon said main valve member thereby moving said main valve member between said predetermined positions.

2. A pilot operated valve assembly as set forth in claim 1 wherein said main valve bore and said pilot valve bore are positioned relative to one another such that the centerline of each of said bores is contained in a single plane which is parallel to the longitudinal axis of said valve body.

3. A pilot operated valve assembly as set forth in claim 1 wherein said valve body includes at least one pilot exhaust port, said pilot valve member further operable to direct pressurized air from said main valve bore through alternating ones of said pilot cylinder ports and out said at least one pilot exhaust port.

4. A pilot operated valve assembly as set fort in claim 1 wherein said valve body includes a pair of pilot exhaust ports, said pilot valve member including a poppet valve having an elongated, reduced diameter portion disposed between a pair of valve elements located distal to either end of said poppet valve;

each of said pair of valve elements including a medial valve and a lateral valve;

each of said medial valves controlling the flow of fluid between said pilot valve bore and said main valve bore through one of said pair of pilot cylinder ports; and each of said lateral valves controlling the flow of fluid between said main valve bore and said pilot exhaust ports through one of said pair of pilot cylinder ports.

5. A pilot operated valve assembly as set forth in claim 1 further including a biasing member for moving said pilot valve member in one direction and an electromechanical actuator for moving said pilot valve member in the opposite direction.

6. A pilot operated valve assembly as set forth in claim 5 wherein said electromechanical actuator includes a solenoid assembly.

7. A pilot operated valve assembly as set forth in claim 6 wherein said pilot valve bore extends longitudinally through said valve body, a retainer is threadably mounted in one end of said pilot valve bore, said biasing member including a coiled spring disposed between said retainer and said pilot valve member to bias said pilot valve member in one direction.

8. A pilot operated valve assembly as set forth in claim 7 wherein said solenoid assembly is mounted to said valve body so as to actuate said pilot valve member within said pilot valve bore in a direction opposite to said biasing force of said coiled spring.

9. A pilot operated valve assembly as set forth in claim 1 wherein said valve body includes a pair of cylinder passages and a pair of exhaust passages each in fluid communication with said main valve bore, said main valve bore including a plurality of lands, said main valve member including a plurality of valve elements defined between said pair of opposed valve heads, said valve elements cooperating with said lands to direct fluid from said main valve bore through various ones of said pair of cylinder passages and said pair of exhaust passages.

* * * * *